US007784242B2

(12) United States Patent
Warnecke

(10) Patent No.: US 7,784,242 B2
(45) **Date of Patent: *Aug. 31, 2010**

(54) DRAIN SUPPORT PLATE/UNDER-DECK CLAMP

(75) Inventor: Lawrence Warnecke, Ladner (CA)

(73) Assignee: Zurn Industries, LLC, Erie, PA (US)

( * ) Notice: Subject to any disclaimer, the term of this patent is extended or adjusted under 35 U.S.C. 154(b) by 609 days.

This patent is subject to a terminal disclaimer.

(21) Appl. No.: 11/122,448

(22) Filed: May 5, 2005

(65) Prior Publication Data

US 2005/0203468 A1 Sep. 15, 2005

Related U.S. Application Data

(62) Division of application No. 10/342,148, filed on Jan. 14, 2003, now Pat. No. 6,953,208.

(60) Provisional application No. 60/348,734, filed on Jan. 15, 2002.

(51) Int. Cl.
*E04G 21/00* (2006.01)

(52) U.S. Cl. ..... 52/745.16; 52/741.1; 52/302.1; 52/198; 52/219; 52/220.8; 210/163; 285/42

(58) Field of Classification Search ..... 52/741, 52/302, 746.11, 302.1, 302.3, 196, 198, 219, 52/220.8, 741.1, 745.15, 745.16, 745.19; 210/163, 164, 165, 166; 285/42, 43, 44
See application file for complete search history.

(56) References Cited

U.S. PATENT DOCUMENTS 228,091 A * 5/1880 Lowell ..... 210/459
412,195 A * 10/1889 Marker ..... 4/289
645,749 A * 3/1900 Kasschau ..... 4/287
728,059 A * 5/1903 Weed ..... 4/287
1,059,671 A * 4/1913 Holt ..... 285/42
1,123,705 A 1/1915 Dehn
1,174,763 A * 3/1916 Redlon ..... 285/44
1,275,922 A * 8/1918 Holt ..... 285/42
1,299,423 A * 4/1919 Bropson ..... 285/42
1,348,945 A * 8/1920 Hirshstein ..... 210/166
1,434,254 A * 10/1922 Sanders ..... 210/163
1,503,421 A * 7/1924 Innes ..... 285/42
1,532,897 A * 4/1925 Hirshstein ..... 285/42
1,538,433 A * 5/1925 Hirshstein ..... 285/42
1,584,986 A * 5/1926 Fleming ..... 210/165
1,690,630 A * 11/1928 Fleming ..... 210/166
1,739,067 A * 12/1929 Fleming ..... 138/89
1,761,257 A * 6/1930 Fleming ..... 210/166
1,762,838 A * 6/1930 Shand ..... 210/166
1,805,816 A * 5/1931 Fleming ..... 285/42
1,809,413 A * 6/1931 Hirshstein ..... 285/42
1,828,601 A * 10/1931 Frye ..... 210/165
1,873,275 A * 8/1932 Boosey ..... 210/165

(Continued)

OTHER PUBLICATIONS

Roof Accessories Company, Inc., "Standard Model Retrofit Drain (SM)", website: www.racdrains.com (pp. 1-3).

*Primary Examiner*—Richard E Chilcot, Jr.
*Assistant Examiner*—Matthew J Gitlin
(74) *Attorney, Agent, or Firm*—The Webb Law Firm

(57) ABSTRACT

A drain support plate for mounting and securing a drain assembly to a deck in a building structure.

21 Claims, 5 Drawing Sheets

U.S. PATENT DOCUMENTS 1,918,509 A * 7/1933 Wilcox ..... 210/166
1,941,537 A * 1/1934 Boosey ..... 285/14
1,963,300 A 6/1934 Fleming
1,973,304 A * 9/1934 Boosey ..... 210/165
1,991,772 A * 2/1935 Rieger et al. ..... 210/166
1,999,277 A * 4/1935 Boosey ..... 210/163
2,019,779 A * 11/1935 Fleming ..... 285/18
2,079,269 A * 5/1937 Williams ..... 138/32
2,091,927 A * 8/1937 Hirshstein ..... 285/341
2,121,220 A * 6/1938 Filkins ..... 210/166
2,127,167 A * 8/1938 Fraters ..... 285/13
2,142,343 A * 1/1939 Boosey ..... 210/166
2,202,147 A * 5/1940 Gerriets ..... 52/99
2,222,807 A * 11/1940 Burr ..... 210/165
2,283,160 A * 5/1942 Boosey ..... 210/163
2,283,365 A * 5/1942 Heinkel ..... 137/328
2,284,416 A * 5/1942 Gordon ..... 210/166
2,299,705 A * 10/1942 Svirsky ..... 138/90
2,400,070 A * 5/1946 Boosey ..... 210/165
2,490,075 A * 12/1949 Matheis ..... 210/165
2,497,577 A * 2/1950 Biggerstaff ..... 210/164
2,501,971 A * 3/1950 Schenck ..... 285/14
2,550,402 A * 4/1951 Boosey ..... 210/165
2,626,674 A * 1/1953 Boosey ..... 285/14
2,666,493 A * 1/1954 Gordon ..... 210/166
2,672,205 A * 3/1954 McDonald ..... 285/42
2,705,542 A * 4/1955 Yavitch ..... 210/165
2,740,490 A * 4/1956 Matheis ..... 210/166
2,743,946 A * 5/1956 Schmid et al. ..... 285/42
2,762,448 A * 9/1956 Schmid et al. ..... 210/166
2,765,865 A * 10/1956 Schmid ..... 210/166
2,783,852 A * 3/1957 Sisk ..... 210/165
2,837,212 A * 6/1958 Schmid ..... 210/166
2,881,921 A * 4/1959 Baker et al. ..... 210/166
2,888,138 A * 5/1959 Baker et al. ..... 210/166
3,095,219 A * 6/1963 Tutty ..... 285/42
3,246,582 A * 4/1966 Wade et al. ..... 210/165
3,420,552 A * 1/1969 Mork ..... 285/42
3,447,329 A * 6/1969 Emberson ..... 137/356
3,469,698 A * 9/1969 Blendermann ..... 210/163
3,469,699 A * 9/1969 Blendermann et al. ..... 210/166
3,516,541 A * 6/1970 Hardingham ..... 210/164
3,529,723 A * 9/1970 Hagedorn ..... 210/163
3,674,149 A * 7/1972 Donalson ..... 210/163
3,774,765 A * 11/1973 Kane et al. ..... 210/164
3,893,919 A * 7/1975 Flegel et al. ..... 210/166
4,092,745 A * 6/1978 Oropallo ..... 4/288
4,243,251 A * 1/1981 Lindquist ..... 285/4
4,423,527 A * 1/1984 Morris et al. ..... 4/288
4,433,860 A * 2/1984 Lindquist ..... 285/192
RE31,561 E * 4/1984 Thompson ..... 4/290
4,462,123 A * 7/1984 Morris et al. ..... 4/286
4,487,690 A * 12/1984 Logsdon ..... 210/163
4,492,491 A * 1/1985 Lunden et al. ..... 405/119
4,505,814 A * 3/1985 Marshall ..... 210/166
4,694,513 A * 9/1987 Kiziah ..... 4/288
4,799,713 A * 1/1989 Uglow ..... 285/42
4,897,974 A * 2/1990 Lane ..... 52/199
4,943,100 A * 7/1990 Emberson ..... 210/164
4,964,180 A * 10/1990 Harbeke ..... 4/288
5,022,430 A * 6/1991 Degooyer ..... 137/362
5,141,633 A * 8/1992 Walczak et al. ..... 210/163
5,154,024 A * 10/1992 Noel ..... 52/12
5,297,817 A * 3/1994 Hodges ..... 285/15
5,372,715 A * 12/1994 Maggard et al. ..... 210/165
5,378,356 A * 1/1995 Logsdon ..... 210/163
5,408,706 A * 4/1995 Barnes ..... 4/507
5,615,526 A * 4/1997 Palmer et al. ..... 52/302.1
5,618,416 A * 4/1997 Haefner ..... 210/163
5,722,791 A * 3/1998 Dallmer ..... 405/52
5,724,777 A * 3/1998 Hubbard ..... 52/198
5,735,091 A * 4/1998 Hawkins et al. ..... 52/302.7
5,829,214 A * 11/1998 Hart ..... 52/302.6
5,966,884 A 10/1999 Uglow
5,974,749 A * 11/1999 Herbert ..... 52/302.1
6,269,495 B1 * 8/2001 Sondrup ..... 4/679
6,378,269 B1 * 4/2002 Wiegand, Sr. ..... 52/745.05
6,381,775 B1 * 5/2002 Sondrup ..... 4/679
6,594,966 B2 * 7/2003 Froeter ..... 52/302.1
6,647,682 B2 * 11/2003 Bishop ..... 52/302.1
6,755,966 B1 * 6/2004 Reed ..... 210/164
6,766,545 B2 * 7/2004 Hodges ..... 4/679
6,833,067 B2 * 12/2004 Dresmann ..... 210/163
6,953,208 B2 * 10/2005 Warnecke ..... 285/42
7,078,616 B2 * 7/2006 Roesch et al. ..... 174/482
2003/0037498 A1 * 2/2003 Bishop ..... 52/302.1
2003/0159384 A1 * 8/2003 Warnecke ..... 52/302.1
2004/0200162 A1 * 10/2004 Wroblewski ..... 52/302.1
2005/0166315 A1 * 8/2005 Warnecke et al. ..... 4/695
2005/0203468 A1 * 9/2005 Warnecke ..... 604/317
2007/0137126 A1 * 6/2007 Sommerhein ..... 52/302.1
2008/0106094 A1 * 5/2008 Edelmayer ..... 285/42
2009/0013620 A1 * 1/2009 West ..... 52/198

* cited by examiner

DRAIN SUPPORT PLATE/UNDER-DECK CLAMP

CROSS-REFERENCE TO RELATED APPLICATIONS

This application is a divisional of U.S. patent application Ser. No. 10/342,148, filed Jan. 14, 2003, which claims the benefit of U.S. Provisional Application Ser. No. 60/348,734, filed Jan. 15, 2002, which are incorporated herein by reference in their entirety.

BACKGROUND OF THE INVENTION

1. Field of the Invention

The present invention relates generally to a drain support plate and, more particularly, to a combined drain support plate and under-deck clamp.

2. Description of the Prior Art

Drains form an integral part of a building structure. For rainwater management, drains are used to keep water from accumulating on the building structure such as a roof. Oftentimes, successful drain installations are directly attributable to various factors, such as the receptacle body of a drain and the various structural conditions (i.e., deck type, thickness, accessibility, and location). A typical prior art drain 10 (shown in FIG. 1) generally includes a circular-shaped receptacle body 12 having a first end 14 and a second end 16, and a basin portion positioned between the first end and second end, a spacer section 18 attached to the first end 14 of the receptacle body 12, a clamping collar 20 attached to the spacer section 18, and a slotted cover 22 attached to the clamping collar 20 for allowing water to pass through the receptacle body 12. The first end 14 of the receptacle body 12 includes an annular flange 24 extending away from the receptacle body 12. A plurality of protrusions 26 are defined adjacent the first end 14 of the receptacle body 12 underneath the flange 24 and extend away from the receptacle body 12. Each protrusion 26 can define a void 28 adapted to receive a fastener. The second end 16 of the receptacle body 12 is adapted to fasten to a drain pipe (not shown).

FIG. 2 shows a prior art drain receiver plate 30 that includes a body 32 having a planar first section 34, a tapered second section 38, and a planar third section 40. Referring to FIGS. 2 and 3, the first section 34 of the body 32 defining a peripheral edge 36 is spaced apart from the third section 40 of the body 32. The third section 40 of the body 32 having an upper surface 41 defines an inner edge 42. The second section 38 of the body 32 is positioned between the first section 34 and the third section 40 of the body 32 and tapers in a direction away from the peripheral edge 36 of the first section 34 of the body 32 toward the inner edge 42 of the third section 40 of the body 32 (shown in FIG. 3). The inner edge 42 of the third section 40 of the body 32 defines a center passageway 44 spaced radially and axially apart from the peripheral edge 36 of the first section 34 of the body 32 and is adapted to receive the receptacle body 12. The third section 40 of the body 32 also defines a plurality of cutouts 46 adapted to receive the protrusions 26 in the receptacle body 12. A distance D between the first section 34 and the third section 40 of the body 32 is sufficient for the upper surface 41 of the third section 40 of the body 32 to abut against a lower surface of the flange 24 on the receptacle body 12 (shown in FIG. 3).

FIG. 3 shows the installation of a prior art drain assembly 50 attached to a building structure 52. The structure 52 includes a deck 54 overlaid with building materials 56 such as waterproofing membranes, insulation or concrete. The assembly 50 includes the prior art drain 10 received within the prior art receiver plate 30, and a clamp 58 adapted to secure the receptacle body 12 to the deck 54, thus preventing axial and radial movement of the drain 10. The clamp 58 (referred to in the industry as an under-deck clamp) is positioned on a bottom surface of the deck 54 abutting the receptacle body 12. A fastener 60 is placed through the clamp 58 and deck 54 and received within the void 28 of the protrusion 26 of the receptacle body 12. The void 28 can be internally threaded for receiving a threaded fastener. A nut and washer arrangement 62 can be placed on the fastener 60, thus securing the clamp 58 against the underside of the deck 54.

When installing the prior art drain assembly 50 shown in FIG. 3, an opening 64 is cut in the deck 54 and the prior art receiver plate 30 is placed on top of the opening 64 in the deck 54. Next, the receptacle body 12 of the drain 10 is received within the passageway 44 of the receiver plate 30, whereby the protrusions 26 in the receptacle body 12 are received within the cutouts 46 in the third section 40 of the receiver plate 30. The remaining components of the drain 10 (i.e., spacer section 18, clamping collar 20 and the slotted cover 22) can then be attached to the receptacle body 12. Next, the clamp 58 is used to securely fasten the receptacle body 12 of the drain 10 to the deck 54 from underneath the deck 54. In order for this fastening to occur, the fastener 60 is received within the void 28 (threaded hole) in the protrusion 26 of the receptacle body 12 via the fastener 60 through the clamp 58 and the deck 54 from a bottom of the structure 52. The materials 56 can then be placed on top of the deck 54.

In the prior art installation, the drain 10 is separate from the clamp 58, thus requiring an installer to have some degree of installation expertise in order to properly install the drain 10. Also, the prior art installation requires an installer to install the drain assembly 50 from both the top and bottom of the roof structure 52, thus increasing installation time. Also, in the prior art installation, the installer must enter an unfinished building which can pose a safety hazard.

An object of the present invention is to reduce drain installation time and expense by eliminating a bottom installation of a drain. Also, an object of the present invention is to permit a safer installation of a drain.

SUMMARY OF THE INVENTION

The present invention provides for a drain support plate adapted to fasten to a receptacle body of a drain. A first end of the receptacle body includes at least one protrusion extending away from the receptacle body. A second end of the receptacle body adapts to fasten to a drain pipe. The drain support plate includes a body having a first portion, an intermediate portion, and a second portion. The first portion of the body is spaced from the second portion of the body. The first portion of the body also defines a peripheral edge. The second portion of the body having an inner edge defines a center passageway spaced radially and axially apart from the peripheral edge of the first portion of the body and adapts to receive the receptacle body. The intermediate portion is positioned between the first portion and the second portion of the body and tapers in a direction away from the peripheral edge of the first portion of the body toward the inner edge of the second portion of the body. An upper surface of the first portion of the body is contained in a first plane and an upper surface of the second portion of the body is contained in a second plane axially spaced from the first plane. The intermediate portion of the body extends from the first plane to the second plane. The first portion of the body can include a plurality of elongated first portion slots defined adjacent the peripheral edge and adapted to receive fasteners for securing the support plate to a deck. The second portion of the body also defines at least one slot adapted to receive a member for attaching the receptacle body to the body of the support plate. A distance between the first portion and the second portion of the body is sufficient for the second portion of the body to support the receptacle body. Further, the slot in the second portion of the body is adapted to be aligned with the receptacle body for receiving a member for attaching the receptacle body to the body of the support plate.

The present invention also provides for a drain support plate assembly that includes a receptacle body of a drain attached to a drain support plate as previously discussed. The support plate can be attached to the receptacle body via a member for attaching the receptacle body to the body of the support plate through the slot in the second portion of the body and the receptacle body. The support plate assembly can also be attached to a deck, wherein the receptacle body extends through an opening in the deck.

The present invention provides for a method of installing a drain in a building structure. First, an opening is formed in a deck. Second, a receptacle body of a drain and a drain support plate as discussed above are provided. Third, the receptacle body of the drain is attached to the second portion of the body of the support plate via a member for attaching the receptacle body to the body of the support plate through the slot in the second portion of the body and the receptacle body. A distance between the first portion and the second portion of the body is sufficient for the second portion of the body to support the receptacle body. Further, the slot in the second portion of the body is adapted to be aligned with the receptacle body for receiving a member for attaching the receptacle body to the body, whereby the receptacle body extends through the center passageway of the body of the support plate. Fourth, the support plate with the attached receptacle body is installed on an upper surface of the deck, wherein the receptacle body extends through the opening in the deck. Further, the support plate can be attached to the deck via fasteners through the first portion slots of the body and the deck or by welding the first portion of the body to the deck.

BRIEF DESCRIPTION OF THE DRAWINGS

A complete understanding of the invention will be obtained from the following description when taken in connection with the accompanying drawing figures wherein like reference characters identify like parts throughout.

DETAILED DESCRIPTION OF THE PREFERRED INVENTION

Figure 1:
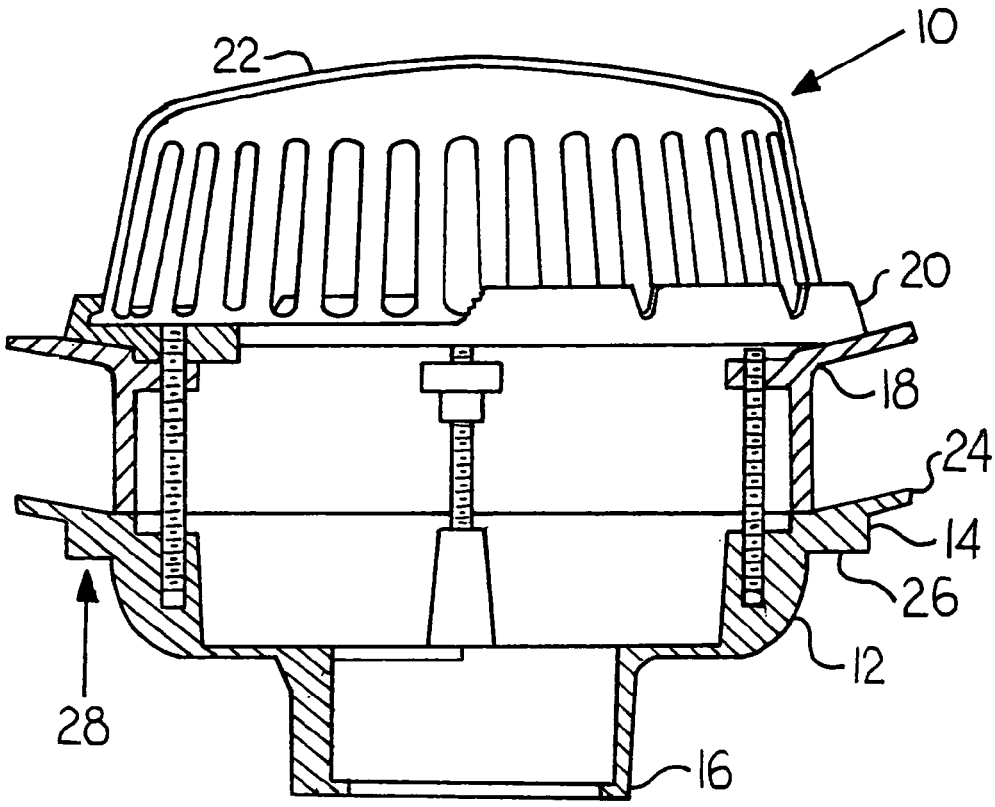
Fig. 1 (Prior Art)
FIG. 1 is a cross-sectional view of a typical prior art drain.
Figure 2:
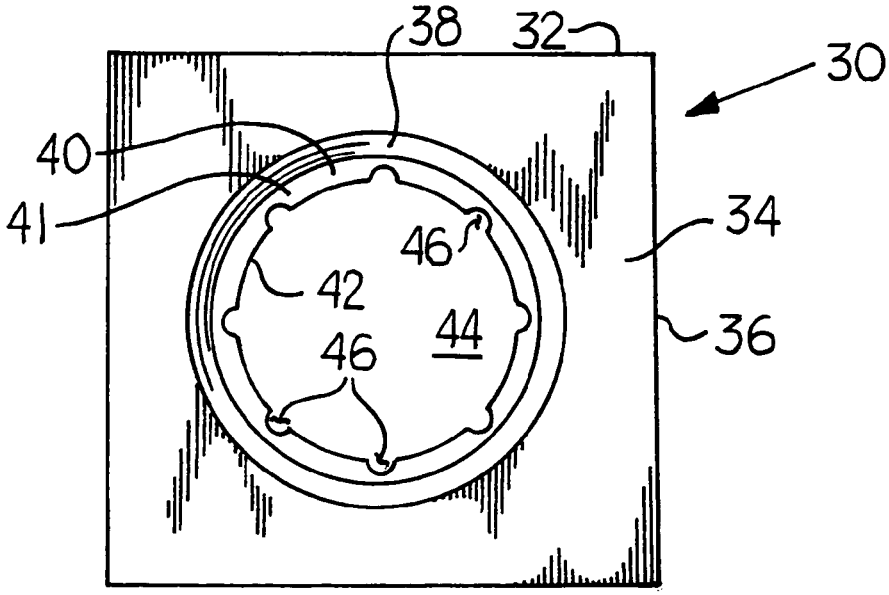
Fig. 2 (Prior Art)
FIG. 2 is a top plan view of a prior art drain receiver plate.
Figure 4:
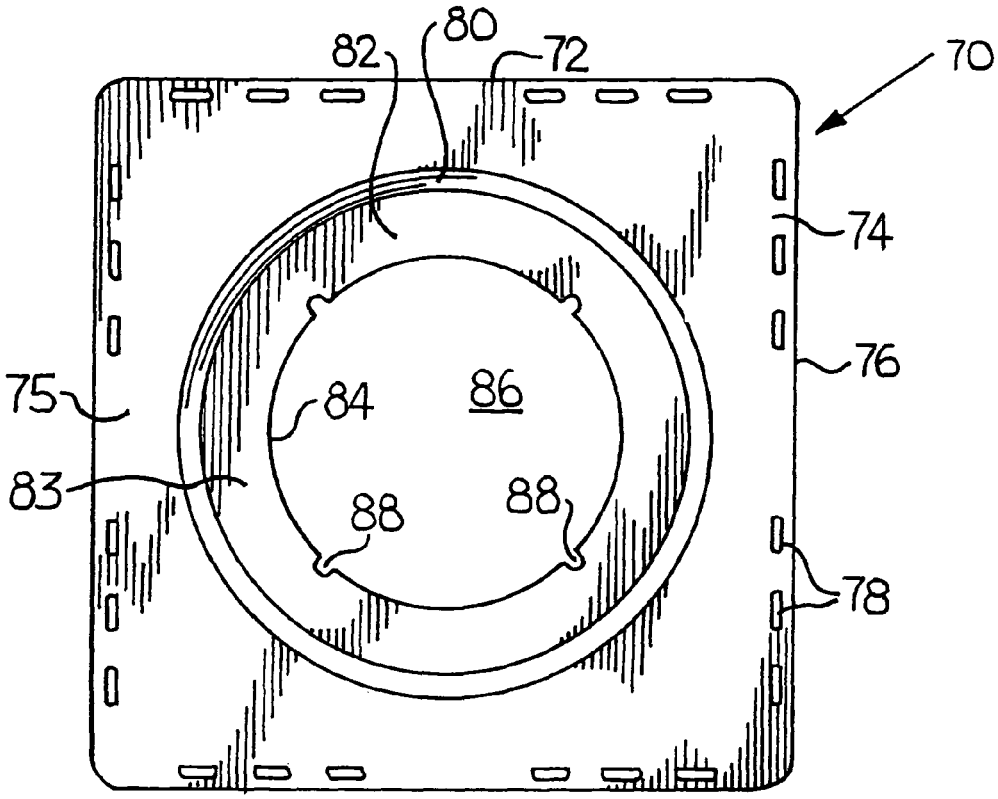
FIG. 4 is a top plan view of a drain support plate made in accordance with the present invention.
Figure 5:
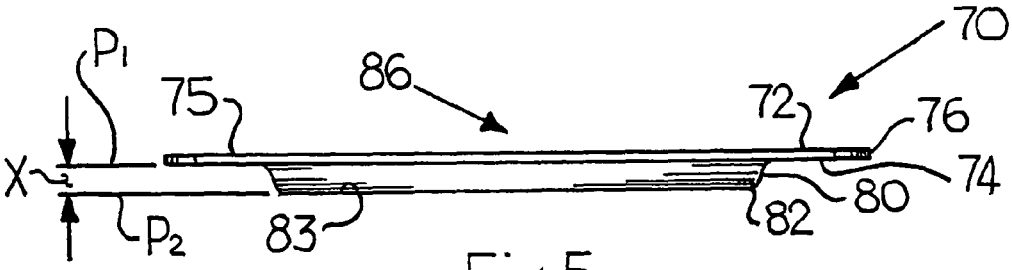
FIG. 5 is an elevational side view of the support plate shown in FIG. 4.
Figure 6:
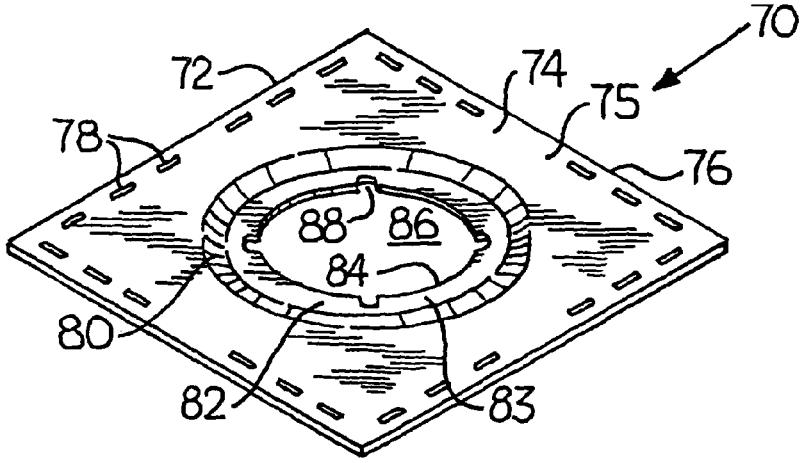
FIG. 6 is a top perspective view of the support plate shown in FIG. 4.

FIGS. 4, 5, and 6 show a drain support plate 70 made in accordance with the present invention that adapts to fasten to a receptacle body 12 of a prior art drain 10 (shown in FIG. 1). The support plate 70 includes a body 72 having a first portion 74, an intermediate portion 80, and a second portion 82. The body 72 can be made of a unitary piece of metal. The first portion 74 of the body 72 is rectangular shaped and defines a peripheral edge 76. The first portion 74 of the body 72 can also include a plurality of first portion slots 78 defined adjacent the peripheral edge 76 and adapted to receive a fastener 104 for securing the support plate 70 to a deck 54 (shown in FIG. 9). The first portion slots 78 can be elongated. The second portion 82 of the body 72 having an inner edge 84 defines a circular-shaped center passageway 86 that is spaced radially and axially apart from the peripheral edge 76 of the first portion 74 of the body 72. The first portion 74 is spaced from the second portion 82 of the body 72 and the intermediate portion 80 is positioned between the first portion 74 and the second portion 82 of the body 72. The intermediate portion 80 of the body 72 tapers in a direction away from the peripheral edge 76 of the first portion 74 of the body 72 toward the inner edge 84 of the second portion 82 of the body 72 (shown in FIG. 6). Referring to FIG. 5, an upper surface 75 of the first portion 74 of the body 72 is contained in a first plane $P_1$ and an upper surface 83 of the second portion 82 of the body 72 is contained in a second plane $P_2$ axially spaced from the first plane $P_1$. The intermediate portion 80 of the body 72 extends from the first plane $P_1$ to the second plane $P_2$. The first plane $P_1$ can also be parallel to the second plane $P_2$.

Figure 8:
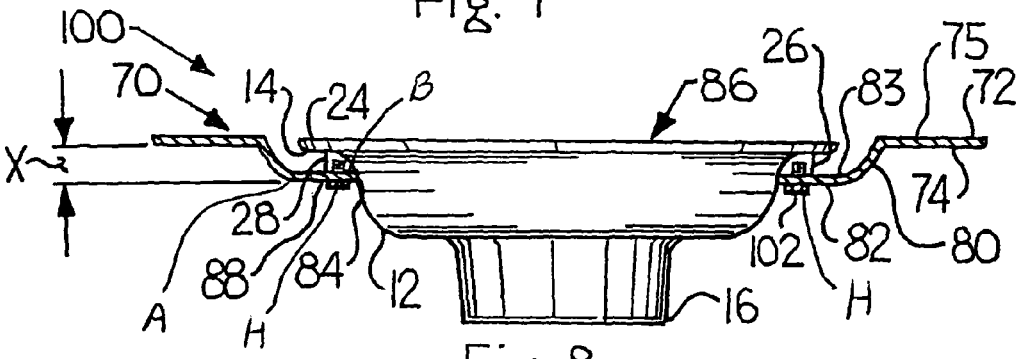
FIG. 8 is an elevational view of a drain support plate assembly made in accordance with the present invention.
Figure 9:
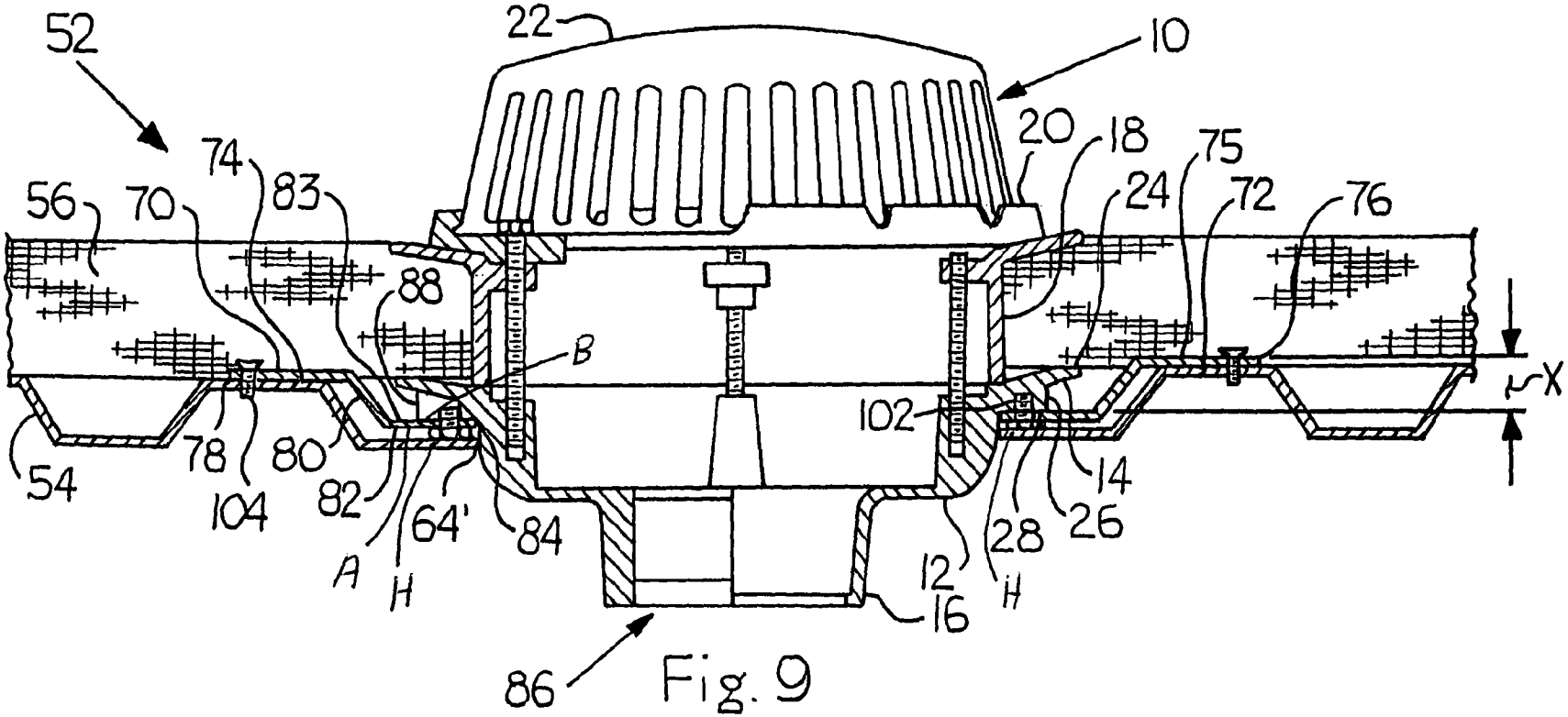
FIG. 9 is a partial cross-sectional view showing a drain installation made in accordance with the present invention utilizing the support plate shown in FIG. 4.

Referring to FIGS. 4 and 6, the inner edge 84 on the second portion 82 of the body 72 defines a plurality of slots 88 adapted to receive a member 102 for attaching the receptacle body 12 of the drain 10 to the body 72 of the support plate 70. The member 102 is a threaded fastener, such as a bolt or screw. The inner edge 84 of the second portion 82 of the body 72 is arcuate shaped and includes a plurality of arcs. Referring to FIGS. 5, 8, and 9, and with continuing reference to FIGS. 4 and 6, a distance X between the first portion 74 and the second portion 82 of the body 72 permits the second portion 82 of the body 72 to extend below the protrusion 26 of the receptacle body 12 of the drain 10. The inner edge 84 is positioned below the protrusion 26 in the receptacle body 12. The slot 88 in the second portion 82 of the body 72 can be adapted to align with the receptacle body 12 for receiving the member 102. The slot 88 in the second portion 82 of the body 72 can also be adapted to align with the void 28 in the protrusion 26 of the receptacle body 12 for receiving the member 102, such as a fastener.

Figure 7:
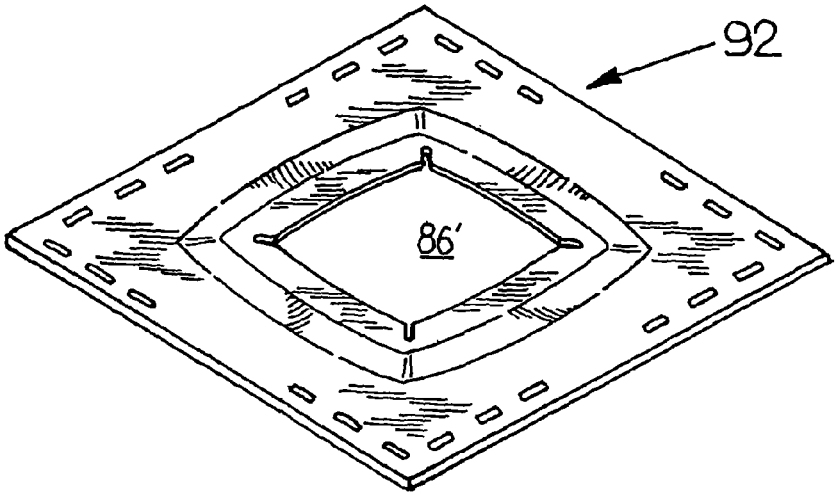
FIG. 7 is a top perspective view of a drain support plate made in accordance with a second embodiment of the present invention.

FIG. 7 shows a second embodiment of a drain support plate 92 similar to support plate 70 except that the center passageway 86' is geometric shaped in order to accommodate various sizes and shapes of a drain.

Referring to FIG. 8, the present invention also provides for a drain support plate assembly 100 that includes the receptacle body 12 of the prior art drain 10 attached to the drain support plate 70. The assembly 100 can be attached via the member 102 (i.e., fastener) for attaching the receptacle body 12 of the drain 10 to the body 72 of the support plate 70 by passing through an underside of the drain support plate 70 through slot 88 in the second portion 82 of the body 72 and the receptacle body 12 for securing the drain support plate 70 to the receptacle body 12. The heads H of the fastener 102 contact an undersurface A of the drain support plate 70 and a portion of the receptacle body 12 contacts an upper surface B of the drain support plate 70. Member 102 preferably is a threaded fastener that can be threadably received by internal threads in the void 28 of the protrusion 26 of the receptacle body 12. However, it is contemplated that member 102 can be formed in receptacle body 12 for engagement with slots 88 for attaching the receptacle body 12 to support plate 70. Referring to FIG. 9, the assembly 100 can be attached to the deck 54 via a fastener 104 through the deck 54 and the first portion slots 78 of the support plate 70, wherein the receptacle body, 12 extends through an opening 64' in the deck 54. Heads or ends of members 102 may rest on an upper surface of the deck 54 sandwiched between the support plate 70 and the deck 54. The fastener 104 can be a sheet metal screw, pin, or rivet. The assembly 100 can also be attached to the deck 54 via welding the first portion 74 of the body 72 to the deck 54. The deck 54 can be made of corrugated metal.

Referring to FIG. 9, the present invention provides for a method of installing a drain 10 on a building structure 52. First, an opening 64' is formed in the deck 54. Second, a drain support plate assembly 100 as previously discussed is provided. The assembly 100 can be pre-assembled prior to installation on a deck or during installation. Third, the support plate assembly 100 is installed on an upper surface of the deck 54, whereby the receptacle body 12 extends through the opening 64' in the deck 54. Fourth, the first portion 74 of the body 72 of the support plate 70 is fastened to the deck 54 via fasteners 104 through the first portion slots 78 in the support plate 70. The support plate assembly 100 can also be attached to the deck 54 via welding the first portion 74 of the body 72 to the deck 54. Fifth, the remaining components of the drain 10 (i.e., spacer section 18, clamping collar 20, and slotted cover 22) can then be attached to the receptacle body 12. Finally, building materials 56 are then placed on top of the deck 54.

Figure 3:
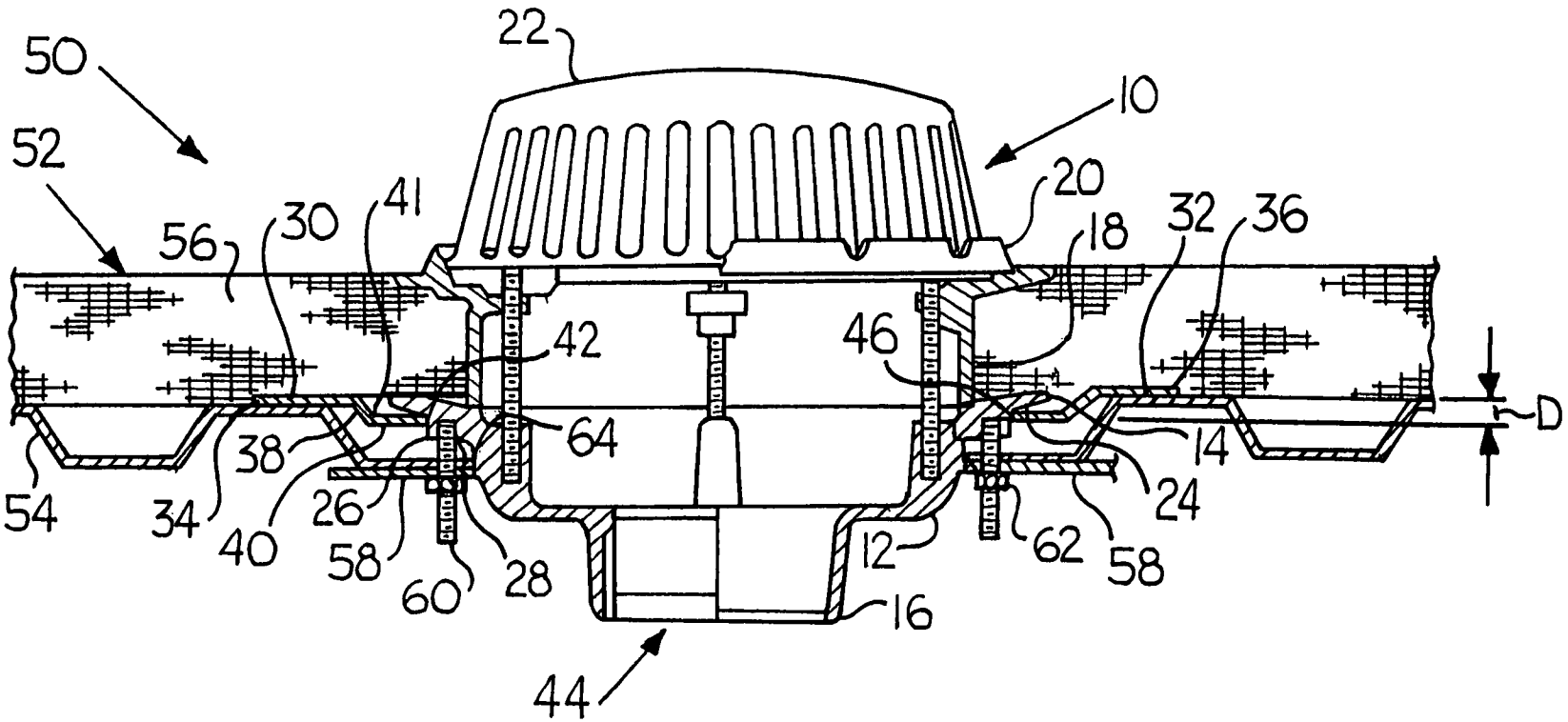
Fig. 3 (Prior Art)
FIG. 3 is a partial cross-sectional view showing a prior art drain installation utilizing the prior art receiver plate shown in FIG. 2.

An advantage to the design of the support plate 70 is that the attachment of the support plate 70 to the receptacle body 12 prior to installation (i.e., support plate assembly 100) eliminates a bottom installation, thus eliminating the need for the under-deck clamp 58 as described in the prior art installation of the drain 10 shown in FIG. 3. The present invention also reduces installation cost and time, and provides for a safer installation by only having a top installation.

It will be understood by those skilled in the art that while the foregoing description sets forth in detail preferred embodiments of the present invention, modifications, additions, and changes might be made thereto without departing from the spirit and scope of the invention.

I claim:

1. A method of installing a drain in a structure, said method comprising the steps of:

a) forming an opening in a deck;

b) providing a receptacle body of a drain, said receptacle body having a first end and a second end, said first end of said receptacle body having at least one protrusion extending away from said receptacle body, said second end of said receptacle body adapted to fasten to a drain pipe;

c) providing a drain support plate having a body, said body having a first portion and a second portion, wherein said first portion of said body is spaced from said second portion of said body, said first portion of said body defining a peripheral edge, said second portion of said body having an inner edge defining a center passageway spaced radially and axially apart from said peripheral edge of said first portion of said body and adapted to receive said receptacle body, and said second portion of said body defining at least one slot adapted to receive a fastener;

d) attaching said receptacle body of said drain to said second portion of said body of said support plate via said fastener passing through an underside of said drain support plate through said slot in said second portion of said body and said receptacle body forming a receptacle body/support plate assembly, wherein a distance between said first portion and said second portion of said body permits said second portion of said body to be positioned completely below the protrusion of said receptacle body, and wherein said slot in said second portion of said body is adapted to be aligned with said receptacle body for receiving said fastener for securing said receptacle body to said body, whereby said receptacle body extends through said center passageway of said body; and e) subsequently installing said receptacle body/support plate assembly with said attached receptacle body to an upper surface of said deck, wherein said receptacle body extends through said opening in said deck.

2. The method as claimed in claim 1, further comprising the step of attaching said support plate to said deck.

3. The method as claimed in claim 2, wherein said body comprises a plurality of first portion slots defined adjacent said peripheral edge of said first portion of said body, and wherein said drain support plate is attached to said deck via fasteners passing through said first portion slots of said body and said deck.

4. The method as claimed in claim 2, wherein said drain support plate is attached to said deck via welding said first portion of said body to said deck.

5. The method as claimed in claim 1, wherein said protrusion in said receptacle body defines a void adapted to receive a fastener, and wherein said slot in said second portion of said body is adapted to be aligned with said void in said protrusion of said receptacle body for receiving said fastener; and wherein said support plate is attached to said receptacle body via said fastener passing through said slot in said second portion of said body and said void in said protrusion of said receptacle body.

6. The method as claimed in claim 5, wherein said fastener is a threaded fastener.

7. A method of installing a drain in a structure, said method comprising the steps of:

a) forming an opening in a deck;

b) providing a receptacle body of a drain, said receptacle body having a first end and a second end, said first end of said receptacle body having at least one protrusion extending away from said receptacle body, said second end of said receptacle body adapted to fasten to a drain pipe;

c) providing a drain support plate having a body, said body having a first portion and a second portion, wherein said first portion of said body is spaced from said second portion of said body, said first portion of said body defining a peripheral edge, said second portion of said body having an inner edge defining a center passageway spaced radially and axially apart from said peripheral edge of said first portion of said body and adapted to receive said receptacle body;

d) attaching said receptacle body of said drain to said second portion of said body of said support plate via a fastener, wherein a distance between said first portion of said body and said second portion of said body permits said second portion of said body to be positioned completely below the protrusion of said receptacle body forming a receptacle body/support plate assembly, whereby said receptacle body extends through said center passageway of said body; and e) subsequently installing said receptacle body/support plate assembly with said attached receptacle body to an upper surface of said deck, wherein said receptacle body extends through said opening in said deck.

8. The method as claimed in claim 7, further comprising the step of attaching said support plate to said deck.

9. The method as claimed in claim 7, wherein said protrusion in said receptacle body defines a void adapted to receive said fastener.

10. The method as claimed in claim 9, wherein said fastener is a threaded fastener.

11. The method as claimed in claim 7, wherein said second portion includes at least one slot.

12. The method as claimed in claim 11, wherein said second portion includes a plurality of slots positioned about the second portion inner edge.

13. The method as claimed in claim 7, wherein said body comprises a plurality of first portion slots defined adjacent said peripheral edge of said first portion of said body, and wherein said drain support plate is attached to said deck via fasteners through said first portion slots of said body and said deck.

14. The method as claimed in claim 7, wherein a portion of said drain support plate is positioned between said fastener and said receptacle body.

15. The method as claimed in claim 7, wherein said fastener contacts an undersurface of said drain support plate and a portion of said receptacle body contacts an upper surface of said drain support plate.

16. A method of installing a drain in a structure, said method comprising the steps of:

a) forming an opening in a deck;

b) providing a receptacle body of a drain, said receptacle body having a first end, second end and a basin portion positioned between the first end and the second end, said second end of said receptacle body adapted to fasten to a drain pipe;

c) providing a drain support plate having a body, said body having a first portion and a second portion, wherein said first portion of said body is spaced from said second portion of said body, said first portion of said body defining a peripheral edge, said second portion of said body having an inner edge defining a center passageway spaced radially and axially apart from said peripheral edge of said first portion of said body and adapted to receive said receptacle body;

d) attaching said receptacle body of said drain to said second portion of said body of said support plate forming a receptacle body/support plate assembly; and e) subsequently installing said receptacle body/support plate assembly with said attached receptacle body to said deck, wherein a bottom surface of the support plate contacts an upper surface of said deck, wherein said receptacle body extends through said opening in said deck.

17. The method as claimed in claim 16 wherein said basin portion of said receptacle body extends through said center passageway of said body of said drain support plate.

18. A method of installing a drain in a structure, said method comprising the steps of:

a) forming an opening in a deck;

b) providing a receptacle body of a drain, said receptacle body having a first end and a second end, said first end of said receptacle body having an annular flange extending away from said receptacle body, said second end of said receptacle body adapted to fasten to a drain pipe;

c) providing a drain support plate having a body, said body having a first portion and a second portion, wherein said first portion of said body is spaced from said second portion of said body, said first portion of said body defining a peripheral edge, said second portion of said body having an inner edge defining a center passageway spaced radially and axially apart from said peripheral edge of said first portion of said body, said first portion and said second portion defining a recess portion adapted to receive said annular flange of said receptacle body when said receptacle body extends through said center passageway of said body;

d) attaching said receptacle body of said drain to said second portion of said body of said support plate via a member for attaching said receptacle body to said body when said annular flange is received within the recess portion of said body of said support plate; and e) subsequently installing said support plate with said attached receptacle body to an upper surface of said deck, wherein said receptacle body extends through said opening in said deck.

19. The method as claimed in claim 12, further comprising the step of attaching said support plate to said deck.

20. The method as claimed in claim 12, wherein said body comprises a plurality of first portion slots defined adjacent said peripheral edge of said first portion of said body, and wherein said support plate is attached to said deck via fasteners through said first portion slots of said body and said deck.

21. The method as claimed in claim 12, wherein said drain support plate is attached to said deck via welding said first portion of said body to said deck.

* * * * *